US012759031B2

(12) United States Patent
Hof et al.

(10) Patent No.: US 12,759,031 B2
(45) Date of Patent: Oct. 13, 2026

(54) SYSTEM AND METHOD FOR THE CONTINUOUS CASTING AND SUBSEQUENT FLAT ROLLING OF A STEEL STRIP

(71) Applicant: SMS group GmbH, Düsseldorf (DE)

(72) Inventors: Hartmut Hof, Erndtebrück (DE); Ingo Schuster, Willich (DE); Matthias Peters, Kreuztal (DE)

(73) Assignee: SMS group GmbH, Düeldorf (DE)

( * ) Notice: Subject to any disclaimer, the term of this patent is extended or adjusted under 35 U.S.C. 154(b) by 652 days.

(21) Appl. No.: 18/024,790

(22) PCT Filed: Sep. 8, 2021

(86) PCT No.: PCT/EP2021/074656
§ 371 (c)(1),
(2) Date: Mar. 6, 2023

(87) PCT Pub. No.: WO2022/053482
PCT Pub. Date: Mar. 17, 2022

(65) Prior Publication Data

US 2024/0278298 A1 Aug. 22, 2024

(30) Foreign Application Priority Data

Sep. 8, 2020 (DE) ..... 10 2020 211 273.8
Sep. 8, 2021 (DE) ..... 10 2021 209 879.7

(51) Int. Cl.
*B21B 1/26* (2006.01)
*B22D 11/00* (2006.01)
(Continued)

(52) U.S. Cl.
CPC ..... *B21B 1/26* (2013.01); *B22D 11/001* (2013.01); *B22D 11/124* (2013.01); *C21D 6/00* (2013.01);
(Continued)

(58) Field of Classification Search
CPC ..... B22D 11/001; B22D 11/124; B22D 11/14–147; B22D 47/00; B22D 47/02; B21B 1/26
See application file for complete search history.

(56) References Cited

U.S. PATENT DOCUMENTS 6,527,882 B1 3/2003 Wehage et al.
6,852,180 B1 2/2005 Faral et al.
(Continued)

FOREIGN PATENT DOCUMENTS

CN 1376209 A 10/2002
CN 103305755 A 9/2013
(Continued)

*Primary Examiner* — Keith Walker
*Assistant Examiner* — Steven S Ha
(74) *Attorney, Agent, or Firm* — Smartpat PLC

(57) ABSTRACT

A system for the continuous casting and subsequent flat rolling of a steel strip with an austenitic and/or ferritic microstructure and a thickness of less than 1.0 mm comprises a casting device with which a raw steel strip with a thickness in the range of 1.50 to 4.0 mm can be continuously cast. At least one hot rolling stand is coupled to the casting device, with which the raw steel strip can be roughed into the steel strip immediately after the casting process while still in the austenitic and/or ferritic microstructure range. At least one rolling module is arranged immediately after the hot rolling stand coupled to the casting device. The rolling module includes, in this order, a cooling device, a heating device and a hot rolling stand with which the roughed steel strip can be hot-rolled in the austenitic and/or ferritic microstructure range to specifications into the steel strip.

11 Claims, 2 Drawing Sheets

(51) Int. Cl.

| | |
|---|---|
| ***B22D 11/124*** | (2006.01) |
| ***C21D 6/00*** | (2006.01) |
| ***C21D 8/02*** | (2006.01) |
| ***C21D 8/021*** | (2026.01) |
| ***C21D 8/0221*** | (2026.01) |
| ***C21D 9/56*** | (2006.01) |
| ***C21D 9/573*** | (2006.01) |
| ***C21D 9/60*** | (2006.01) |

(52) U.S. Cl.
CPC ..... *C21D 8/02* (2013.01); *C21D 8/021* (2013.01); *C21D 8/0226* (2013.01); *C21D 9/56* (2013.01); *C21D 9/573* (2013.01); *C21D 9/60* (2013.01); *C21D 2211/001* (2013.01); *C21D 2211/005* (2013.01)

(56) References Cited

U.S. PATENT DOCUMENTS

| | | | | |
|---|---|---|---|---|
| 2009/0320546 | A1* | 12/2009 | Seidel | C21D 11/00 72/200 |
| 2014/0366602 | A1 | 12/2014 | Fang et al. | |
| 2017/0199357 | A1 | 7/2017 | Craen et al. | |
| 2018/0179612 | A1 | 6/2018 | Jeong et al. | |
| 2021/0317543 | A1 | 10/2021 | Fang et al. | |

FOREIGN PATENT DOCUMENTS

| | | | |
|---|---|---|---|
| CN | 103305746 | B | 9/2015 |
| CN | 107186185 | A | 9/2017 |
| DE | 112013000841 | | 10/2014 |
| EP | 2340897 | A1 | 7/2011 |
| WO | 9601710 | A1 | 1/1996 |
| WO | 2007051521 | A2 | 5/2007 |
| WO | 2016009078 | A1 | 1/2016 |
| WO | 2020052625 | A1 | 3/2020 |

* cited by examiner

SYSTEM AND METHOD FOR THE CONTINUOUS CASTING AND SUBSEQUENT FLAT ROLLING OF A STEEL STRIP

CROSS-REFERENCE TO RELATED APPLICATION

This application is a national stage application, filed under 35 U.S.C. § 371, of International Patent Application No. PCT/EP2021/074656, filed on 8 Sep. 2021, which claims the benefit of German Patent Application No. 10 2020 211 273.8, filed 8 Sep. 2020, and German Patent Application No. 10 2021 209 879.7, filed 8 Sep. 2021.

TECHNICAL FIELD

The present invention relates to a system and to a method for the continuous casting and subsequent flat rolling of a steel strip with an austenitic and/or ferritic microstructure and a thickness of less than 1.0 mm.

BACKGROUND

Steel strips with an austenitic and/or ferritic microstructure and a thickness of less than 1.0 mm, particularly with a thickness in the range of 0.40 to 0.60 mm, are usually produced by cold-rolling hot strips in separate cold rolling mills so that at least two or three processing steps are necessary to manufacture such thin steel strips with an austenitic and/or ferritic microstructure.

The German publication DE 11 2013 000841 T5 discloses a system for manufacturing thin steel strips, wherein a cast strip with a thickness of 1 to 5 mm can be cast and hot-rolled directly in a hot rolling mill into a thin steel strip; such a system, however, does not allow the targeted manufacture of steel strips with an austenitic and/or ferritic microstructure.

SUMMARY

An object of the present disclosure is to provide an improved system vis-à-vis the prior art as well as an improved method vis-à-vis the prior art, in particular to provide a system or method which enables the manufacture of a steel strip with an austenitic and/or ferritic microstructure and with a thickness of less than 1.0 mm.

The object is achieved by means of a system and a method as described herein.

The system, which is provided and/or suitable for the continuous casting and subsequent flat rolling of a steel strip with an austenitic and/or ferritic microstructure and a thickness of less than 1.0 mm, comprises a casting device with which a raw steel strip with a thickness in the range of 1.50 to 4.0 mm can be continuously cast, as well as at least one hot rolling stand which is coupled to the casting device and with which the raw steel strip can be roughed immediately after the casting process into the steel strip while still in the austenitic and/or ferritic microstructure range.

The system comprises at least one rolling module arranged immediately after the hot rolling stand coupled to the casting device, which rolling module includes, in this order, a cooling device, a heating device as well as a hot rolling stand with which the roughed steel strip in the austenitic and/or in the ferritic microstructure range can be hot-rolled to specifications into the steel strip.

Analogously, the present invention provides a method for manufacturing a steel strip with an austenitic and/or ferritic microstructure and with a thickness of less than 1.0 mm, wherein a raw steel strip with a thickness in the range of 1.50 to 4.0 mm is first continuously cast in a casting device and then roughed directly in the austenitic and/or ferritic microstructure range, preferably above a temperature of at least 700° C., into the steel strip by means of at least one hot rolling stand coupled to the casting device.

The steel strip that has been roughed in the austenitic and/or in the ferritic microstructure range is then hot-rolled to specifications into the steel strip via at least one rolling module, which includes, in this order, a cooling device, a heating device and a hot rolling stand, and which is arranged immediately after the hot rolling stand coupled to the casting device.

The system or method facilitates an improved economic efficiency in hot strip production, in particular in the production of ultra-thin hot strip, since it is possible to significantly reduce delivery times, lower investment costs and achieve substantial energy savings through the reduction of the number of process steps.

The combination in the term "austenitic and/or ferritic microstructure" is understood in the sense of the present invention to mean that the steel strip to be manufactured possesses an austenitic or a ferritic microstructure at the end of the process and can be rolled in austenitic as well as ferritic conditions during manufacture. In other words, the steel strip to be manufactured essentially does not exhibit a mixed structure that includes an austenitic and a ferritic structure at the end of the process.

The term "ultra-thin hot-rolled strip" is understood in the sense of the present invention to mean a steel strip that has a thickness of less than 1.0 mm, preferably a thickness of less than 0.80 mm, particularly preferably a thickness in the range of 0.40 to 0.60 mm. Most preferably, the steel strip exhibiting an austenitic and/or ferritic microstructure has a thickness of 0.4 mm.

It is also possible to provide an austenitic and/or ferritic microstructure in the steel strip in a targeted manner via the at least one rolling module. In order to produce, for example, a ferritic microstructure in the steel strip, the austenitically or ferritically roughed steel strip is cooled via the cooling device before then being rolled in ferritic conditions to specifications in the rolling stand of the rolling module, preferably in a temperature range of 700 to 780° C. If, on the other hand, an austenitic microstructure is to be provided in the steel strip, then the austenitically or ferritically roughed steel strip is heated via the heating device before being rolled in austenitic conditions to specifications in the rolling stand of the rolling module, preferably above a temperature of 850° C.

Further advantageous embodiments are indicated in the dependent claims. The individual features listed in the dependent claims can be combined with one another in a technologically meaningful manner and can define further embodiments of the invention. The features indicated in the claims are also elucidated and explained in the description, wherein further preferred embodiments of the invention are described.

In an advantageous variant embodiment, the system can comprise at least two, more preferably at least three, rolling modules arranged one behind the other, wherein each of the rolling modules respectively includes, in this order, a cooling device, a heating device and a hot rolling stand in order to respectively enable a hot rolling in an austenitic and/or ferritic microstructure range. This allows the total degree of deformation in the respective austenitic and/or ferritic microstructure to be varied by the number of implemented deformations, whereby the quality parameters of the steel strip can be advantageously influenced.

In a further advantageous variant embodiment, the system can also comprise a heating device arranged between the casting device and the hot rolling stand coupled to the casting device in order to enable a targeted intermediate heating of the raw steel strip arriving from the casting device before it is roughed in austenitic conditions in the hot rolling stand.

Preferably, the system comprises, after the at least one rolling module and particularly preferably after the last rolling module, at least one cooling section over which the steel strip is cooled to a coiling temperature. In this connection, it is advantageously provided that the system comprises at least one coiling device, more preferably at least two coiling devices, via which the completed steel strip is wound into a coil. The system usually further comprises a separating device arranged before the coil device for separating the steel strip.

In a further variant embodiment, the system can also comprise a pickling device for pickling and/or a heat treatment device for annealing the steel strip, which is then arranged between the, preferably last, rolling module and the cooling section.

In a further aspect, the present invention also relates to the use of the system according to the invention for the targeted manufacture of a steel strip with an austenitic and/or ferritic microstructure and a thickness of less than 1.0 mm, preferably with a thickness of less than 0.80 mm, particularly preferably with a thickness in the range of 0.40 to 0.60 mm.

BRIEF DESCRIPTION OF THE DRAWINGS

The invention and the technical context are explained in more detail in the following with reference to the figures. It should be noted that it is not intended for the invention to be limited by the illustrated example embodiments. In particular, unless explicitly stated otherwise, it is also possible to combine elements of the subject matter illustrated in the figures with other elements and findings in the present description and/or figures. In particular, it should be noted that the figures and in particular the illustrated size ratios are only schematic. Identical reference signs designate identical objects so that explanations relating to other figures may be applicable.

DETAILED DESCRIPTION

Figure 1:
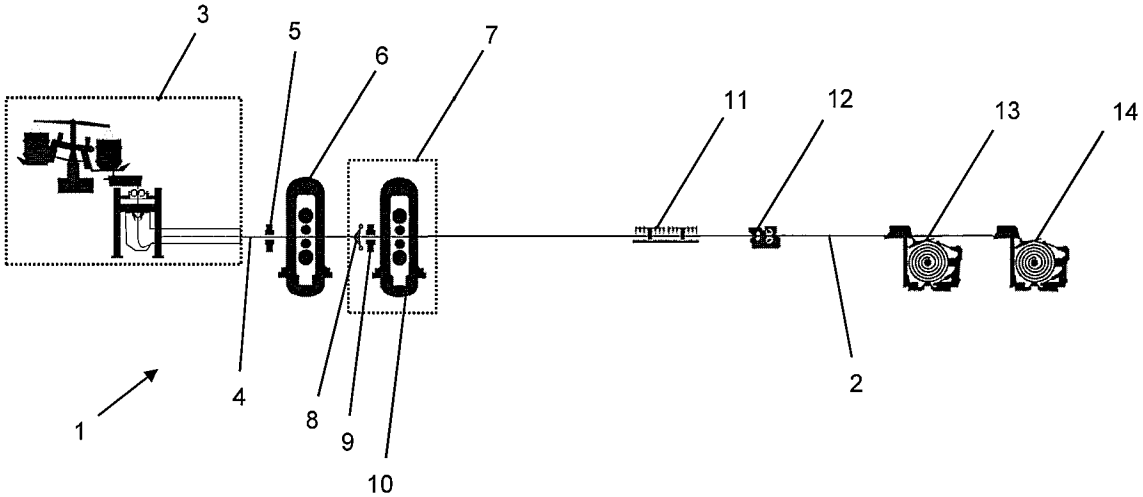
FIG. 1 shows a first variant embodiment of the system for the continuous casting and subsequent flat rolling of a steel strip (2) with an austenitic and/or ferritic microstructure.

FIG. 1 shows a variant embodiment of a system 1 by means of which it is possible to manufacture a steel strip 2 with an austenitic and/or ferritic microstructure with a thickness of less than 1.0 mm by continuous casting and subsequent flat rolling.

In the illustrated variant embodiment, the system 1 comprises a casting device 3 which is continuously supplied with molten steel. A raw steel strip 4 with a thickness in the range of 1.50 to 4.0 mm is first continuously cast via the casting device 3. Arranged behind the casting device 3 in the direction of travel of the strip is a first heating device 5 via which the raw steel strip 4 can be heated before the first rolling pass in cases where the temperature is below 700° C. and/or the first deformation step is to be carried out in the austenitic microstructure range. The first heating device 5 can be implemented, for example, in the form of an inductive heating device. The system 1 further comprises a first hot rolling stand 6 coupled directly to the casting device 3. By the term "coupled directly" it is understood in the sense of the present invention that the first hot rolling stand 6 is arranged directly behind the casting device 3 in the direction of travel of the strip so that the raw steel strip 4 produced by the casting device 3 can be roughed directly and thus in the austenitic and/or ferritic microstructure range.

The system 1 further comprises, behind the first hot rolling stand 6 in the direction of travel of the strip, a first rolling module 7 which includes, in this order, a first cooling device 8, a second heating device 9 as well as a second hot rolling stand 10 with which the austenitically or ferritically roughed steel strip 2 is hot-rolled in the austenitic and/or ferritic microstructure range to specifications into the steel strip 2. The second heating device 9 can also be implemented, for example, in the form of an inductive heating device. The first cooling device 10 can be implemented, for example, in the form of an intermediate cooling between stands.

Behind the first rolling module 7 in the direction of travel of the strip, the system 1 first comprises a cooling section 11, which is preferably implemented in the form of a spray cooling and by means of which the steel strip 2 that has been rolled to the desired final strip thickness, for example a final strip thickness of 0.4 mm, can be gently cooled on account of the extremely small thickness. The steel strip 2 subsequently passes through a separating device 12, which can consist of, for example, a flying shear, and is wound into a coil via a first and/or a second coiling device 13, 14.

Figure 2:
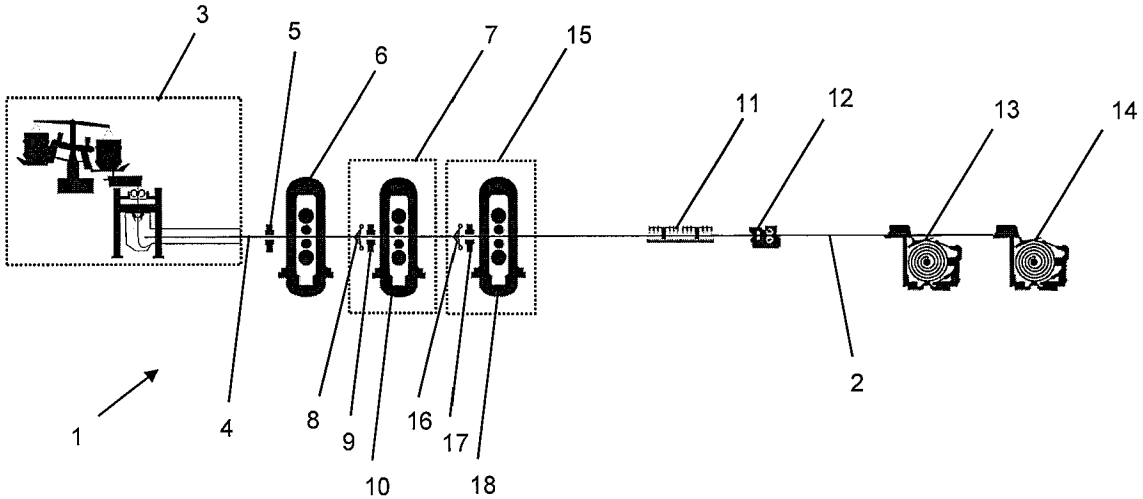
FIG. 2 shows a second variant embodiment of the system for the continuous casting and subsequent flat rolling of a steel strip (2) with an austenitic and/or ferritic microstructure.

FIG. 2 shows a second variant embodiment of the system 1 according to the invention, which, in contrast to the first variant embodiment, comprises a second rolling module 15, which in this scenario includes a second cooling device 16, a third heating device 17 as well as a third hot rolling stand 18 via which a rolling in the austenitic and/or ferritic microstructure range is rendered possible.

EXAMPLES

Example 1

To manufacture a steel strip 2 with a purely austenitic microstructure, a raw steel strip 4 with a thickness of 2.0 mm and a width of 1100 mm was first cast by means of the system 1 shown in FIG. 1. The raw steel strip 4 had a temperature of 1250° C. upon exiting the casting device 3 and was then heated from an entry temperature of 1157° C. to 1246° C. via an induction heater 5. The raw steel strip 4 was then roughed in austenitic conditions at a rolling speed of 2.52 m/s in the first hot rolling stand 6 with a reduction of 55%, wherein the entry temperature was 1130° C. and the exit temperature was 971° C. The thus obtained 0.9 mm thick, austenitically roughed steel strip 2 was then rolled to specifications via the first rolling module 7 by first heating it from 938° C. to a temperature of 1051° C. via the induction heater 9 before it was hot-rolled to specifications in austenitic conditions at a rolling speed of 3.78 m/s in the second hot rolling stand 10 with a reduction of 33%. The entry temperature into the second hot rolling stand 10 was 992° C. and the exit temperature was 882° C. The thus obtained steel strip 2, which had a final strip thickness of 0.6 mm, was then cooled and wound into a coil.

Example 2

In order to manufacture a steel strip 2 with a purely ferritic microstructure, a raw steel strip 4 with a thickness of 2.0 mm and a width of 1100 mm was first cast by means of the system 1 shown in FIG. 1. The raw steel strip 4 had a temperature of 1250° C. upon exiting the casting device 3 and, due to the sufficiently high temperature, was fed without heating to the hot rolling stand 6 where it was roughed in austenitic conditions at a rolling speed of 2.22 m/s with a reduction of 55%, wherein the entry temperature was 1020° C. and the exit temperature was 882° C. The thus obtained 0.9 mm thick, austenitically roughed steel strip 2 was then rolled in ferritic conditions to specifications via the first rolling module 7 by first cooling it from 794° C. to a temperature of 785° C. via the cooling device 8 and then hot-rolled to specifications at a rolling speed of 3.33 m/s in the second hot rolling stand 10 with a reduction of 33%. The entry temperature into the second hot rolling stand 10 was 757° C. and the exit temperature was 705° C. The thus obtained steel strip 2, which had a final strip thickness of 0.6 mm, was then cooled and wound into a coil.

REFERENCE SIGNS

1 System
2 Steel strip
3 Casting device
4 Raw steel strip
5 First heating device/induction heater
6 First hot rolling stand
7 (First) rolling module
8 First cooling device
9 Second heating device/induction heater
10 Second hot rolling stand
11 Cooling section/spray cooling
12 Separating device/
13 First coiling device
14 Second coiling device
15 Second rolling module
16 Second cooling device
17 Third heating device
18 Third rolling stand

The invention claimed is:

1. A system (1) for the continuous casting and subsequent flat rolling of a steel strip (2) having an austenitic and/or ferritic microstructure and a thickness of less than 1.0 mm, comprising a casting device (3) configured to continuously cast a raw steel strip (4) having a thickness in the range of 1.50 mm to 4.0 mm;

at least one hot rolling stand (6) coupled to the casting device (3) configured to rough-roll the raw steel strip (4) into the steel strip (2) immediately after casting while still in the austenitic and/or ferritic microstructure range; and at least one rolling module (7) arranged immediately after the at least one hot rolling stand (6) coupled to the casting device (3), wherein the at least one rolling module (7) includes, in this order, a cooling device (8), a heating device (9), and a hot rolling stand (10)

configured to hot-roll the steel strip (2) in the austenitic and/or in the ferritic microstructure range to the thickness of less than 1.0 mm.

2. The system (1) according to claim 1, wherein at least one cooling section (11) is provided after the at least one rolling module (7).

3. The system (1) according to claim 1, wherein the at least one rolling module (7) comprises at least two rolling modules (7, 15) respectively arranged one behind the other, wherein each of the at least two rolling modules (7, 15) includes, in this order, a cooling device (8, 16), a heating device (9, 17), and a hot rolling stand (10, 18).

4. The system (1) according to claim 1, wherein the at least one rolling module (7) comprises at least three rolling modules (7, 15) respectively arranged one behind the other, wherein each of the at least three rolling modules (7, 15) includes, in this order, a cooling device (8, 16), a heating device (9, 17), and a hot rolling stand (10, 18).

5. The system (1) according to claim 4, further comprising a pickling device for pickling and/or a heat treatment device for annealing the steel strip (2) arranged after a last rolling module (15) of the at least three rolling modules (7, 15).

6. The system (1) according to claim 4, wherein at least one cooling section (11) is provided after a last rolling module (15) of the at least three rolling modules (7, 15).

7. The system (1) according to claim 1, further comprising at least one heating device (5) arranged before the at least one hot rolling stand (6) coupled to the casting device (3).

8. The system (1) according to claim 1, further comprising a pickling device for pickling and/or a heat treatment device for annealing the steel strip (2) arranged after the at least one rolling module (7).

9. The system (1) according to claim 1, further comprising at least one coiling device (13, 14) for coiling the steel strip (2) into a coil.

10. The system (1) according to claim 9, further comprising a separating device (12) arranged before the at least one coiling device (13, 14) for separating the steel strip (2).

11. The system (1) according to claim 1, further comprising at least two, coiling devices (13, 14) for coiling the steel strip (2) into a coil.

* * * * *